US011927422B2

(12) United States Patent
Hahn

(10) Patent No.: US 11,927,422 B2
(45) Date of Patent: Mar. 12, 2024

(54) ADJUSTABLE ARCHERY BOW CAM

(71) Applicant: Bear Archery, Inc., Evansville, IN (US)

(72) Inventor: David Eugene Hahn, Elberfeld, IN (US)

(73) Assignee: Bear Archery, Inc., Evansville, IN (US)

( * ) Notice: Subject to any disclaimer, the term of this patent is extended or adjusted under 35 U.S.C. 154(b) by 0 days.

(21) Appl. No.: 17/732,756

(22) Filed: Apr. 29, 2022

(65) Prior Publication Data

US 2023/0349660 A1 Nov. 2, 2023

(51) Int. Cl.
*F41B 5/10* (2006.01)

(52) U.S. Cl.
CPC ..... *F41B 5/105* (2013.01)

(58) Field of Classification Search
CPC ..... F41B 5/10; F41B 5/105
USPC ..... 124/25.6, 900
See application file for complete search history.

(56) References Cited

U.S. PATENT DOCUMENTS 6,082,347 A * 7/2000 Darlington ..... F41B 5/105 124/900
6,250,293 B1 * 6/2001 Andrews ..... F41B 5/10 124/900
RE37,544 E * 2/2002 Darlington ..... F41B 5/10 124/900
6,360,735 B1 * 3/2002 Larson ..... F41B 5/105 124/900
6,516,790 B1 * 2/2003 Darlington ..... F41B 5/10 124/900
6,575,153 B2 * 6/2003 Lommasson ..... F41B 5/105 124/900
6,691,692 B1 * 2/2004 Adkins ..... F41B 5/10 124/900
7,082,937 B1 * 8/2006 Land ..... F41B 5/105 124/900
7,690,372 B2 * 4/2010 Cooper ..... F41B 5/105 124/25.6
7,721,721 B1 * 5/2010 Kronengold ..... F41B 5/10 124/90
8,534,269 B2 * 9/2013 Wilson ..... F41B 5/10 124/900
8,544,456 B2 * 10/2013 Grace ..... F41B 5/10 124/900
8,671,925 B2 * 3/2014 Grace ..... F41B 5/10 124/900
8,683,989 B1 * 4/2014 McPherson ..... F41B 5/10 124/900
9,121,658 B1 * 9/2015 Darlington ..... F41B 5/123
(Continued)

*Primary Examiner* — Alexander R Niconovich
(74) *Attorney, Agent, or Firm* — Woodard. Emhardt, Henry, Reeves & Wagner, LLP

(57) ABSTRACT

Aspects of the present disclosure deal with cams and/or cam systems mounted or mountable on an archery bow. In one embodiment, the cam system is a hybrid cam system with a master/drive cam and a slave/driven cam. The cam system is designed to enable large draw length adjustments to fit a variety of archers. To facilitate the draw length adjustment, the master/drive cam includes a control module. The slave/driven cam includes an adjustable control cable post. In one example, the control module and the control cable post may have three different mounting locations, each corresponding to a different draw length range.

15 Claims, 11 Drawing Sheets

(56) References Cited

U.S. PATENT DOCUMENTS

| | | | | |
|---|---|---|---|---|
| 9,335,114 | B2 * | 5/2016 | Yi | F41B 5/105 |
| 9,347,730 | B2 * | 5/2016 | Obteshka | F41B 5/10 |
| 9,417,028 | B2 * | 8/2016 | Hyde | F41B 5/10 |
| 9,423,202 | B1 * | 8/2016 | Obteshka | F41B 5/105 |
| 9,441,907 | B1 * | 9/2016 | Obteshka | F41B 5/105 |
| 9,506,714 | B1 * | 11/2016 | Eacker | F41B 5/105 |
| 9,581,407 | B2 * | 2/2017 | Yi | F41B 5/105 |
| 9,739,562 | B1 * | 8/2017 | Obteshka | F41B 5/105 |
| 10,260,833 | B1 * | 4/2019 | Rinker | F41B 5/105 |
| 2013/0074819 | A1 * | 3/2013 | McPherson | F41B 5/105<br>124/25.6 |
| 2015/0345890 | A1 * | 12/2015 | McPherson | F41B 5/1469<br>124/25.6 |
| 2023/0074333 | A1 * | 3/2023 | Wilson | F41B 5/105 |
| 2023/0349661 | A1 * | 11/2023 | Shamblen | F41B 5/105 |

* cited by examiner

ADJUSTABLE ARCHERY BOW CAM

FIELD OF THE DISCLOSURE

Aspects of the present invention deal with archery bows and more particularly pertain to cam and/or cam systems for use with and/or mounted to archery bows.

BACKGROUND

An archery bow stores energy when an archer draws the bowstring. When the bowstring is released, the stored energy propels the arrow. A bow typically has a central riser portion, with upper and lower limbs extending to limb tips. In compound bow arrangements, rotatable elements, often called wheels or cams, are respectively mounted at the upper and lower limb tips. The cable arrangements of the compound bows are arranged between the opposing limb tips and the cams.

Compound archery bows generally include cam adjustment modules "mods" configured to enable an archer to adjust a draw length of the bow. Having a bow with the proper draw length for an archer is critical in assuring accuracy and repeatability in the shot process. However, archery bows are generally only able to adjust the draw length within relatively small ranges. For example, an archery bow may have a draw length adjustability range from 25-30 inches. While this range may work for some archers, other archers, particularly short and/or tall archers, may require a draw length outside of that draw length adjustability range.

SUMMARY

Embodiments of the present disclosure include an adjustable cam system for archery bows. In one embodiment, the cam system is a hybrid system with a master/drive cam and a slave/driven cam. The cam system is designed to enable large draw length adjustments to fit a variety of archers. For example, the cams may enable a draw length adjustment from 18-31 inches.

To facilitate the draw length adjustment, the master/drive cam includes a control module in combination with a draw length module. The control module is rotatable about an axis formed by an axle of the bow. For example, the control module may have three different mounting locations, each corresponding to a different draw length range. In one example, a first mounting location includes the draw length range from 26.5-31 inches, a second mounting location includes the draw length range from 22-26 inches, and a third mounting location includes the draw length range from 18-21.5 inches. Generally, the control module is fastened to the master/drive cam via a pair of fasteners, such as screws, bolts, and/or other removable fasteners.

The draw length module (mod) is configured to nest around the control module. In setting up the bow, an archer must first decide the draw length range desired and adjust the control module to the corresponding range. Then, the archer adjusts the draw length mode to select a specific draw length value within the draw length range set by the control module. For example, the control module may be first positioned to set the draw length value between 26.5-31 inches. Then, for example, the draw length module is positioned around the draw length module to select a specific draw length value such as 29 inches. The draw length mod is configured to nest around the control module to prevent a user and/or bow shop from improperly positioning the draw length mod. For example, a hook and/or protrusion is configured to abut the control module when reaching a rotation limit.

To facilitate the draw length adjustment of the slave/driven cam, the slave/driven cam includes an adjustable control cable post. For example, the control cable post may include three different mounting locations. In one embodiment, the mounting locations correspond to the mounting locations of the control module. For example, attaching the control cable post at a first position corresponds to a draw length of 26.5-31 inches, attaching the control cable post at a second position corresponds to a draw length of 22-26 inches, and attaching the control cable post at a third position corresponds to a draw length of 18-21.5 inches. Generally, the control cable post is fastened to the slave/driven cam via a fastener, such as a screw, bolt, and/or other removable fastener.

A control cable extends from the control module on the master/drive cam to the control cable post on the slave/driven cam. The control cable is further configured to synchronize and/or tie the movement of the master/drive cam to the slave/driven cam to rotate the cams in sync on a hybrid style bow.

Other objects and attendant advantages will be readily appreciated, as the same become better understood by reference to the following detailed description when considered in connection with the accompanying drawings.

DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles being contemplated as would normally occur to one skilled in the art to which the disclosure relates.

Embodiments of the present disclosure include adjustable cam systems for archery bows. The cam system is designed to enable large draw length adjustments to setup a bow for a variety of archers. A master/drive cam includes a control module in combination with a draw length module. The control module may have a series of mounting locations, each corresponding to a different draw length range. The draw length module (mod) is configured to nest around the control module. In setting up the bow, an archer must first decide the draw length range desired and adjust the control module to the corresponding range. Then, the archer adjusts the draw length mode to select a specific draw length value within the draw length range set by the control module. To facilitate the draw length adjustment of the slave/driven cam, the slave/driven cam includes an adjustable control cable post.

Figure 1:
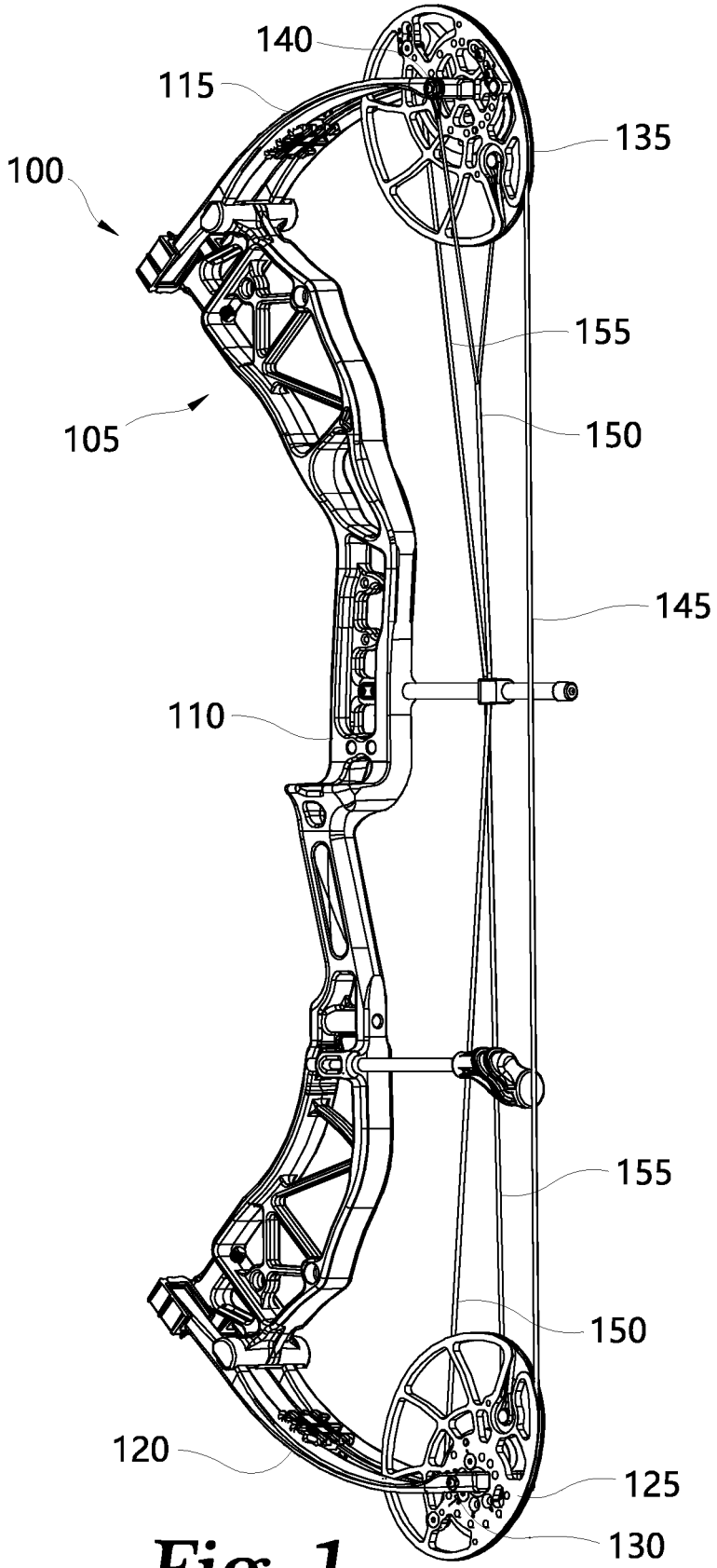
FIG. 1 is a representative embodiment of an archery bow including a cam system according to an embodiment of the present disclosure.

FIG. 1 illustrates a representative example of an archery bow 100 incorporating a cam system according to the present disclosure. The archery bow 100 includes a riser 110 with a handle, an upper limb or pair of upper limbs 115 and a lower limb or pair of lower limbs 120. In the embodiment shown, upper and lower limbs are formed of parallel and symmetric limbs sometimes called a quad limb arrangement. Alternately, a single piece limb can have a notch or slot area removed to allow a rotational element to be mounted to the limb tips. In the hybrid cam example illustrated, rotational members such as lower cam 125 and upper cam 135 are supported at the limb tip sections for rotary movement about axles, such as lower axle 130 and upper axle 140. An upper axle 140 is carried between the outer limb tip portions of upper limb 115. A lower axle 130 is carried between the outer limb tip portions of lower limb 120.

The portion of the string which defines the bowstring 145 includes an upper portion and a lower portion which are fed-out from lower cam 125 and upper cam 135 when the bow is drawn. Additionally, a buss cable 150 has a lower end mounted to lower cam 125 which extends into a y-yoke with two upper ends mounted adjacent opposing ends of upper axle 140 at a pair of yoke mounting posts 325 (shown in FIG. 3). A control cable 155 has a lower end mounted to the lower cam 125 and an upper end mounted to the upper cam 135. Each cable has a thickness and a round cross-section defining a circumference. From the perspective of the archer, the bowstring is considered rearward relative to the riser which defines forward.

When the bowstring 145 is drawn, it causes lower cam 125 and upper cam 135 at each end of the bow to rotate, taking up buss cable 150 and bending limbs 115 and 120 inward, causing energy to be stored therein. Simultaneously, the control cable 155 is taken up to synchronize the position of the lower cam 125 and the upper cam 135. When the bowstring 145 is released with an arrow engaged to the bowstring, the upper limb 115 and lower limb 120 return to their rest position, causing lower cam 125 and upper cam 135 to rotate in the opposite direction, to take up the bowstring 145 and launch the arrow with an amount of energy proportional to the energy initially stored in the bow limbs. Archery bow 100 is described for illustration and context and is not intended to be limiting.

While not illustrated, embodiments of the present disclosure can also be used in other types of bows, for example dual cam, binary cam, and/or single cam bows. For convenience, the combination of riser 110 and either single or quad limbs forming upper limb 115 and lower limb 120 may generally be referred to as archery bow body 105. Accordingly, it should be appreciated that the archery bow body can take on various designs in accordance with the many different types of bows with which the present disclosure can be used.

Various accessories, such as arrow rests, stabilizers, sights, and/or quivers can be mounted to bow body 105. Commonly, sights are used in combination with a peep sight mounted within the bowstring 145.

Figure 2:
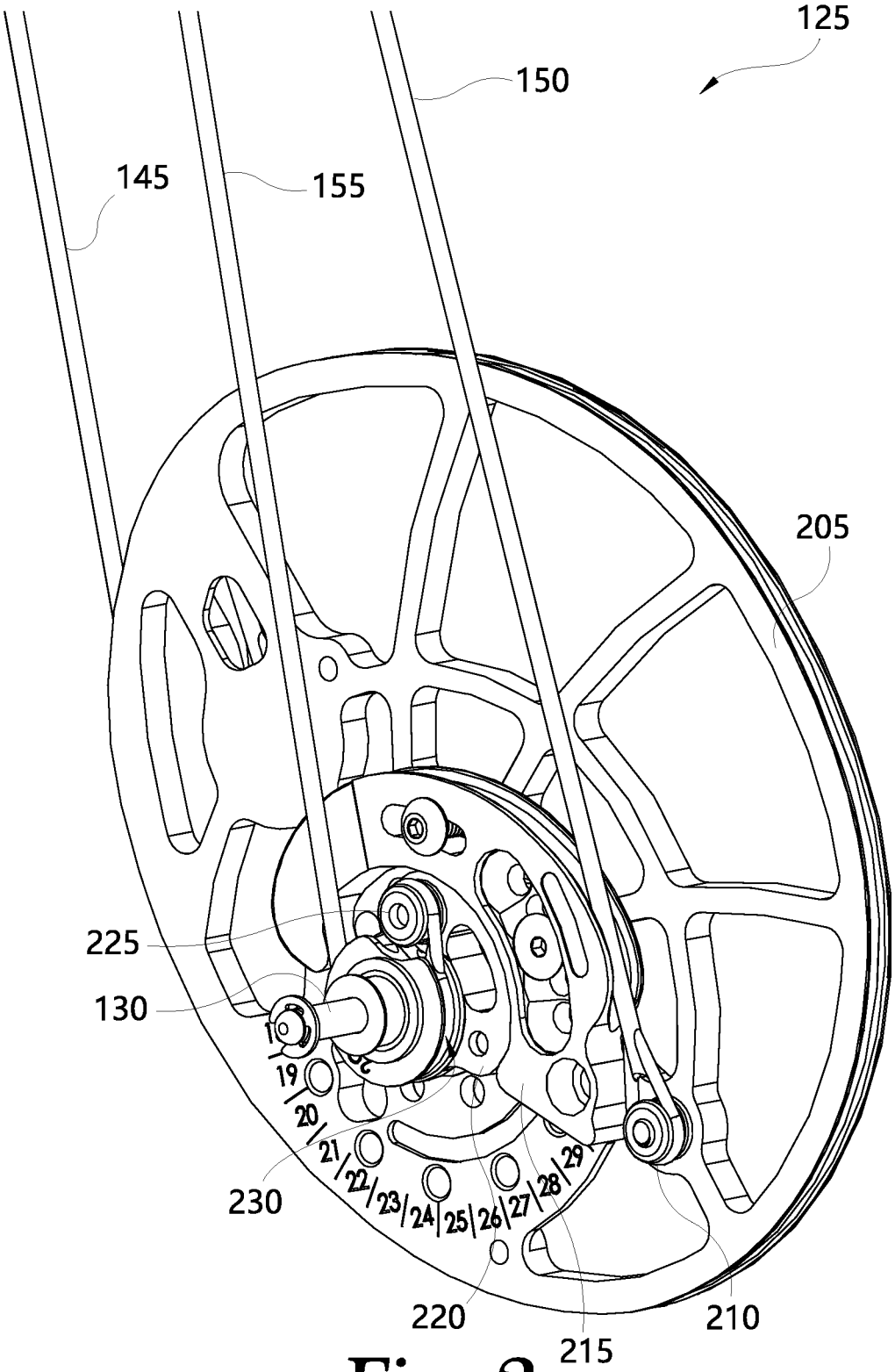
FIG. 2 is a perspective view of a master/drive cam including one or more strings and one or more cables according to an embodiment of the present disclosure.
Figure 5:
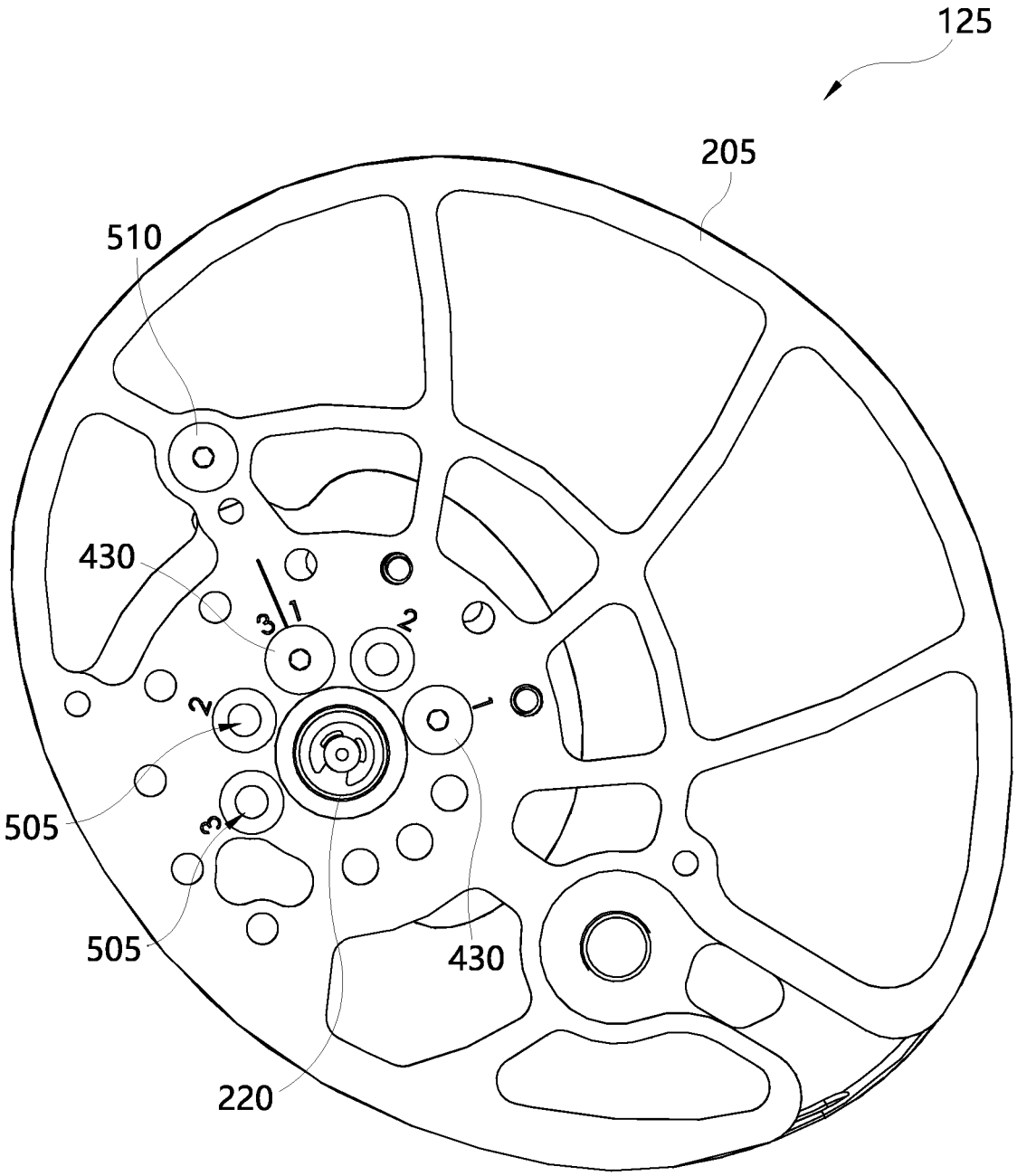
FIG. 5 is a side view of a second side of the master/drive cam of FIG. 2.

Shown in FIG. 2 is an example of a lower cam 125. In one example, the lower cam 125 is in the form of a master and/or drive cam. However, in other embodiments, the lower cam 125 may be a slave and/or driven cam. The lower cam 125 includes a lower cam body 205 with an integral peripheral track configured to retain a portion of the bowstring 145. As can be seen in FIGS. 1 and 5, the bowstring 145 wraps around the track and then anchors, at one end, to a post fixed to the lower cam 125. For example, as the bowstring 145 is drawn by an archer, the lower cam 125 pays out bowstring 145 from the peripheral track. Mounted to the lower cam body 205 is a buss cable post 210 configured to retain one end of the buss cable 150. The buss cable post 210 is mounted to the lower cam body 205 via a fastener 510 (shown in FIG. 5). Located adjacent the lower axle 130 is a draw length adjustment module 215 and a control module 220.

The adjustment module 215 includes a peripheral track configured to interact with and/or take up the buss cable 150 during drawing of the bowstring 145. The control module 220 includes a removable control cable post 225 configured to retain one end of the control cable 155. The control module 220 further includes an integral peripheral track 230 configured to retain and/or pay out control cable 155 during drawing of the bowstring 145. As should be appreciated, both the adjustment module 215 and the control module 220 are adjustable in combination in order to correspond with various draw lengths. Put differently, the adjustment module 215 and the control module 220 cooperate to adjust the draw length. Typically, a draw length range is initially set using the control module 220 and then a draw length value within the draw length range is selected via the positioning of adjustment module 215. For example, the adjustment module 215 and the control module 220 may be adjustable for draw lengths ranging from 15-33 inches. In another example, the control module 220 may include one or more distinct mounting location. In yet another example, the control module 220 may include three mounting locations corresponding to three different draw length ranges. For example, a first mounting location corresponds to a draw length range from 26.5-31 inches, a second mounting location corresponds to a draw length range from 22-26 inches, and a third mounting location corresponds to a draw length range from 18-21.5 inches.

Figure 3:
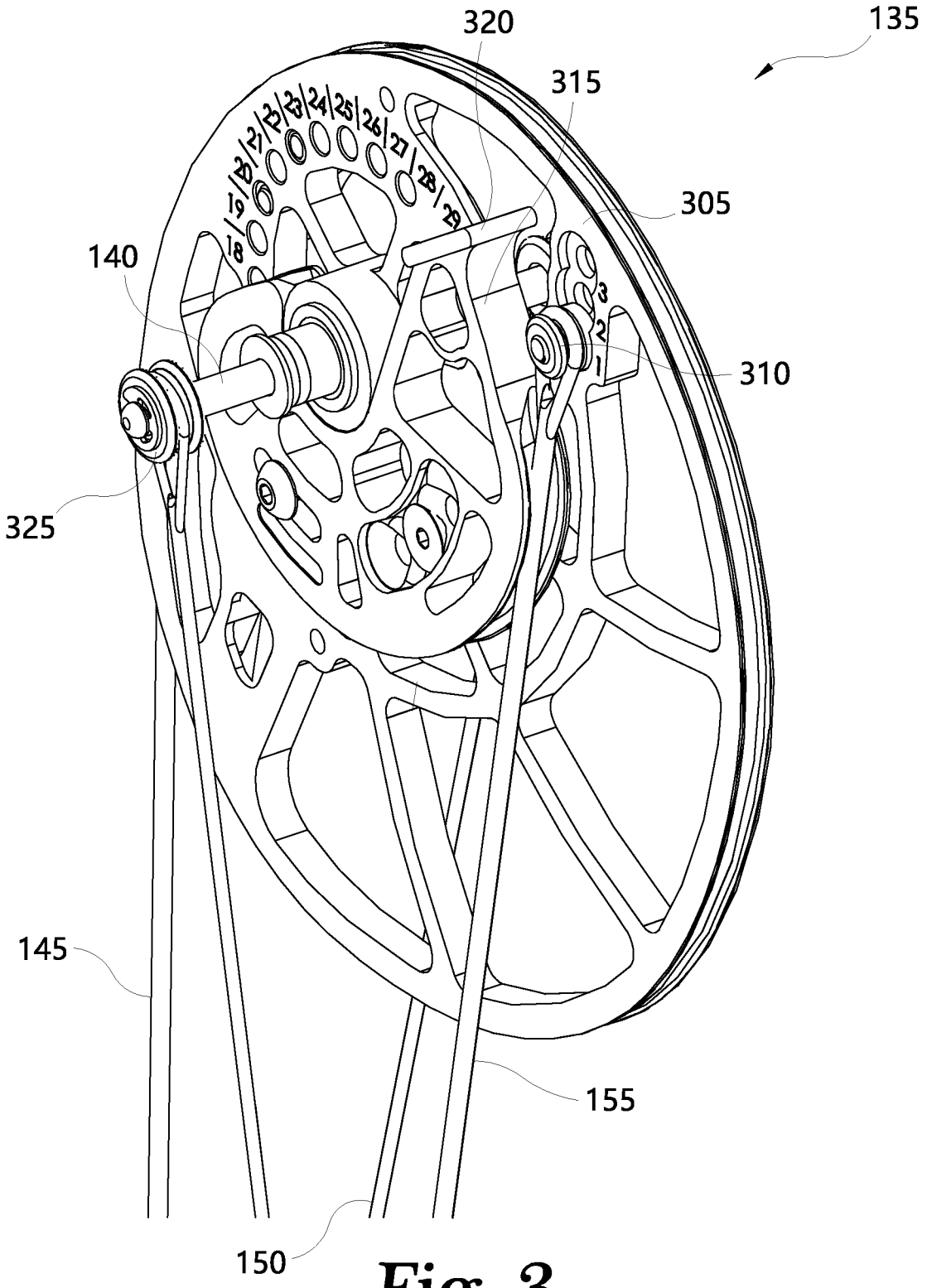
FIG. 3 is a perspective view of a slave/driven cam including the strings and cables according to an embodiment of the present disclosure.

FIG. 3 shows an example of the upper cam 135. In one example, the upper cam 135 is in the form of a slave and/or driven cam. However, in alternate embodiments, the upper cam 135 may be a master and/or drive cam. The upper cam 135 includes an upper cam body 305 defining an integral peripheral track. The track is configured to retain a portion of the bowstring 145. An end of the bowstring is retained via a post mounted to the upper cam 125 (shown in FIG. 8). The upper cam body 305 further includes an adjustable control cable post 310. The adjustable control cable post 310 is configured to secure one end of the control cable 155. In one example, the control cable post 310 may be positioned in one of a series of mounting locations, corresponding to the mounting locations of the control module 220. For example, a first mounting location corresponds to a draw length range from 31-26.5 inches, a second mounting location corresponds to a draw length range from 26-22 inches, and a third mounting location corresponds to a draw length range from 21.5-18 inches.

Mounted adjacent the upper axle 140 is an adjustment module 315. The adjustment module 315 includes an integral track configured to take up a portion of the control cable 155 as the bowstring 145 is drawn. As should be appreciated, the control cable 155 is configured to synchronize the lower cam 125 and the upper cam 135 such that the lower cam 125 and the upper cam 135 are in time with one another. The adjustment module 315 further includes a cable stop 320. The cable stop 320 is configured to contact the control cable 155 when the desired draw length is reached by an archer during the draw cycle. For example, once the bowstring 145 is drawn back to the set draw length value the cable stop 320 contacts the control cable 155 forming the "wall" of the draw cycle.

Figure 4:
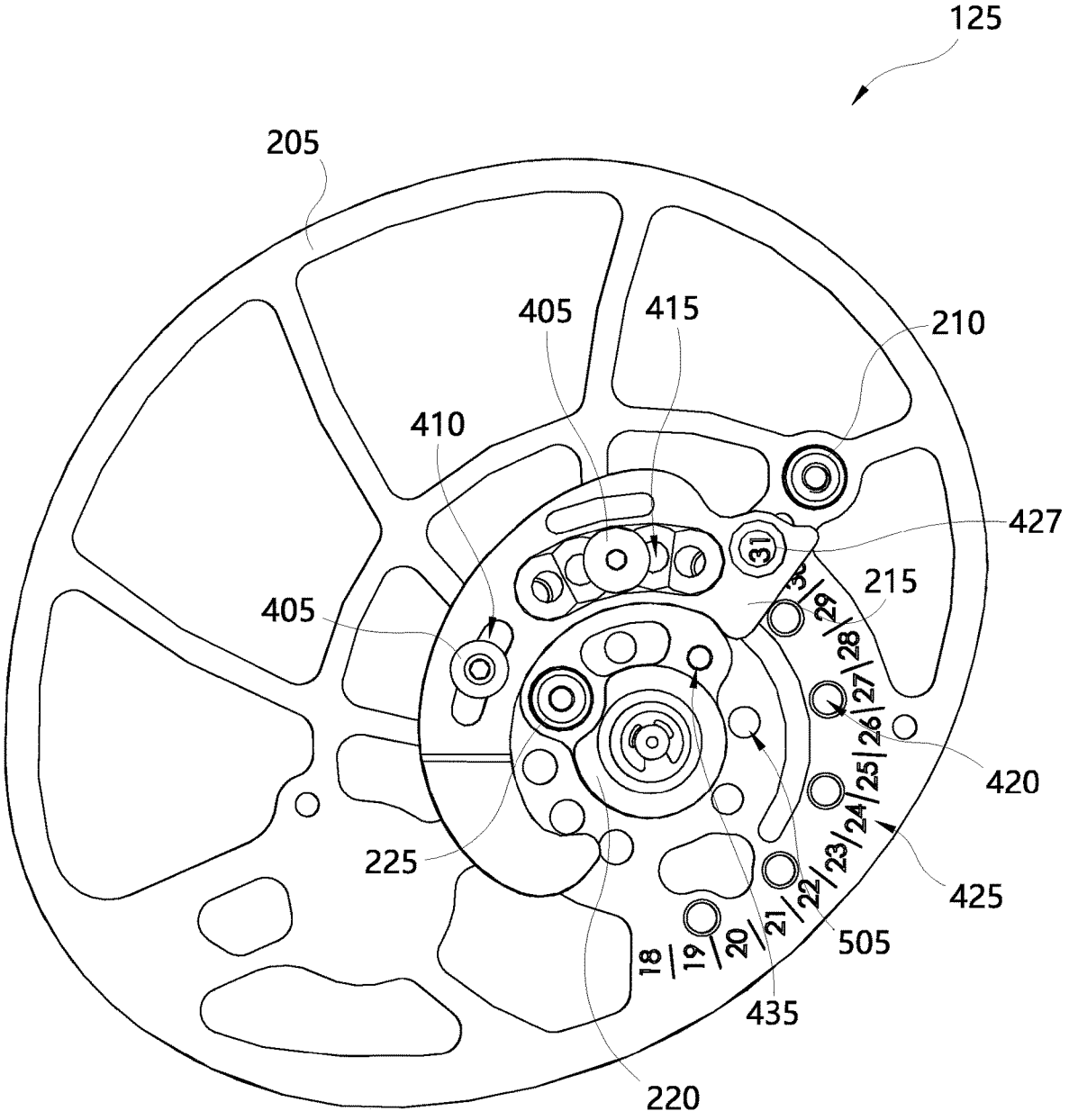
FIG. 4 is side view of a first side of the master/drive cam of FIG. 2.
Figure 6:
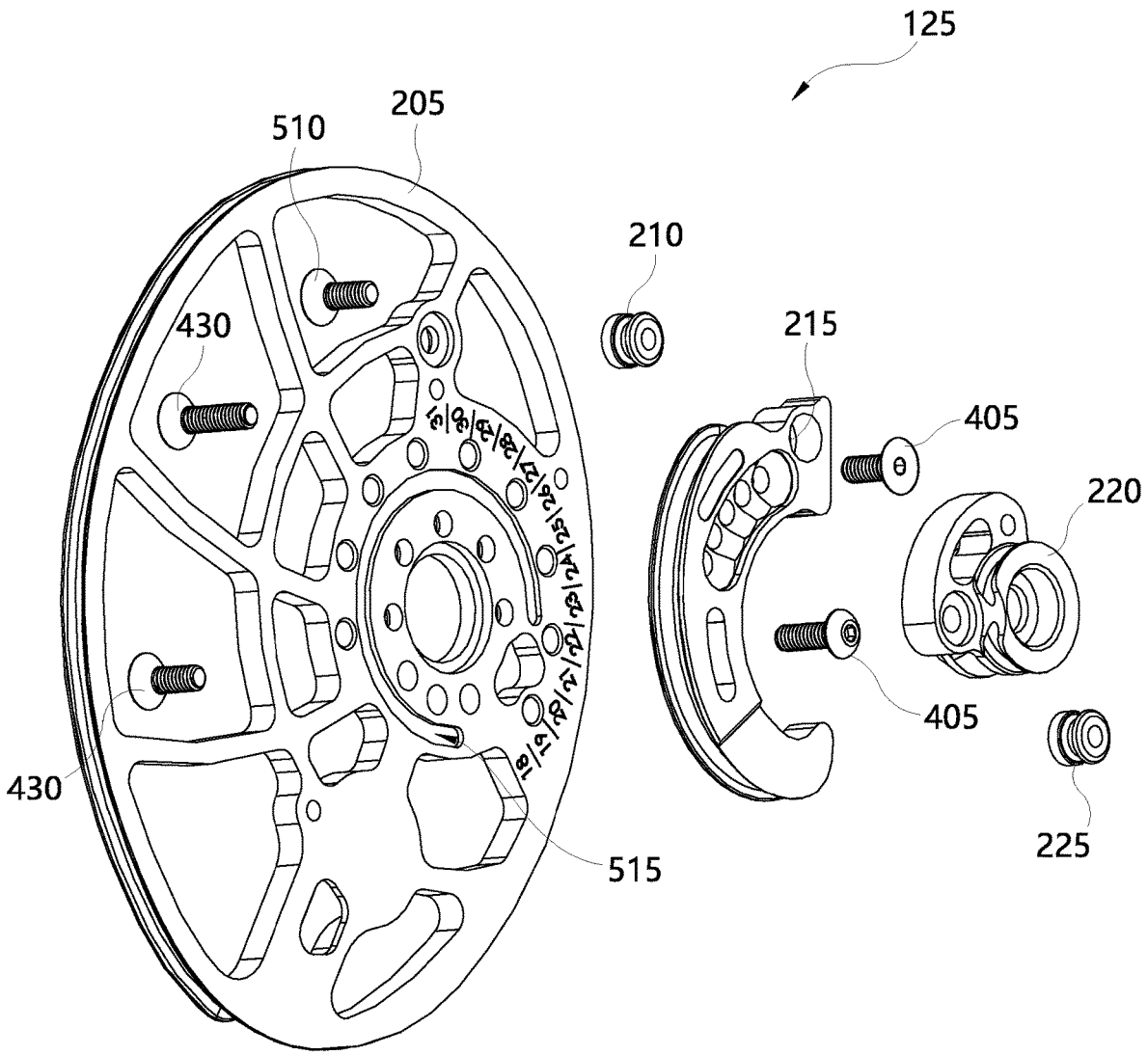
FIG. 6 is an exploded view of the master/drive cam of FIG. 2.

FIGS. 4, 5, and 6 show multiple views of the lower cam 125. Located adjacent the adjustment module 215 is the control module 220. The control module 220 is mounted to the lower cam 125 via one or more fasteners 430 (shown best in FIG. 5). The fasteners 430 may be in the form of bolts, rivets, screws, nails, and/or other fasteners. The fasteners 430 typically attach to the control module 220 via one or more mounting holes 435. In one example, the fasteners 430 attach to the mounting holes 435 in the control module and corresponding apertures 505 in the cam body via a threaded connection. The control module 220 is rotatable about an axis formed by the lower axle 130 in order to adjust the draw length range of the archery bow 100. As should be appreciated, the fasteners 430 may be selectively removed when desired and the control module 220 rotated to a desired position, with a fastener then secured to a corresponding cam aperture 505. Based on the cam aperture 505 selected, the adjustment module 215 is positioned to define a selected draw length range. For example, with the control module 220 in a cam aperture 505, corresponding to a first draw length range, the adjustment module 215 is adjustable between 26.5 and 31 inches. With the control module 220 in a second cam aperture 505, corresponding to a second draw length range, the adjustment module 215 is adjustable between 22 and 26 inches. With the control module 220 in a third cam aperture 505, corresponding to a third draw length range, the adjustment module 215 is adjustable between 18 and 21.5 inches.

As also shown, the adjustment module 215 is mounted adjacent the control module and to the lower cam 125 via one or more fasteners 405. In one example, the fasteners 405 are threadedly connected to the lower cam 125. The fasteners 405 may include bolts, rivets, screws, nails, and/or any other fastener. The fasteners 405 are configured to extend through a slot 410 and/or a hole 415 defined by the adjustment module 215 and into one or more apertures 420. The apertures 420 are configured to correspond with a predetermined draw length value. The adjustment module 215 further optionally includes a window 427 configured to display the selected draw length value for ease of an archer. Similarly, the lower cam 125 may include one or more draw length indicators 425, such as numbers or other inscribed indicia, configured to work in tandem with the window 427 to display the selected draw length value.

The adjustment module 215 may be rotated around an axis formed by the lower axle 130 in order to adjust the draw length value. To assist in proper orientation of the adjustment module 215, the lower cam 125 defines a groove 515 configured to interact with a tongue on the 215 (not shown for ease of illustration). The tongue is configured to slide within a path defined by the groove to properly align the adjustment module 215.

Figure 7:
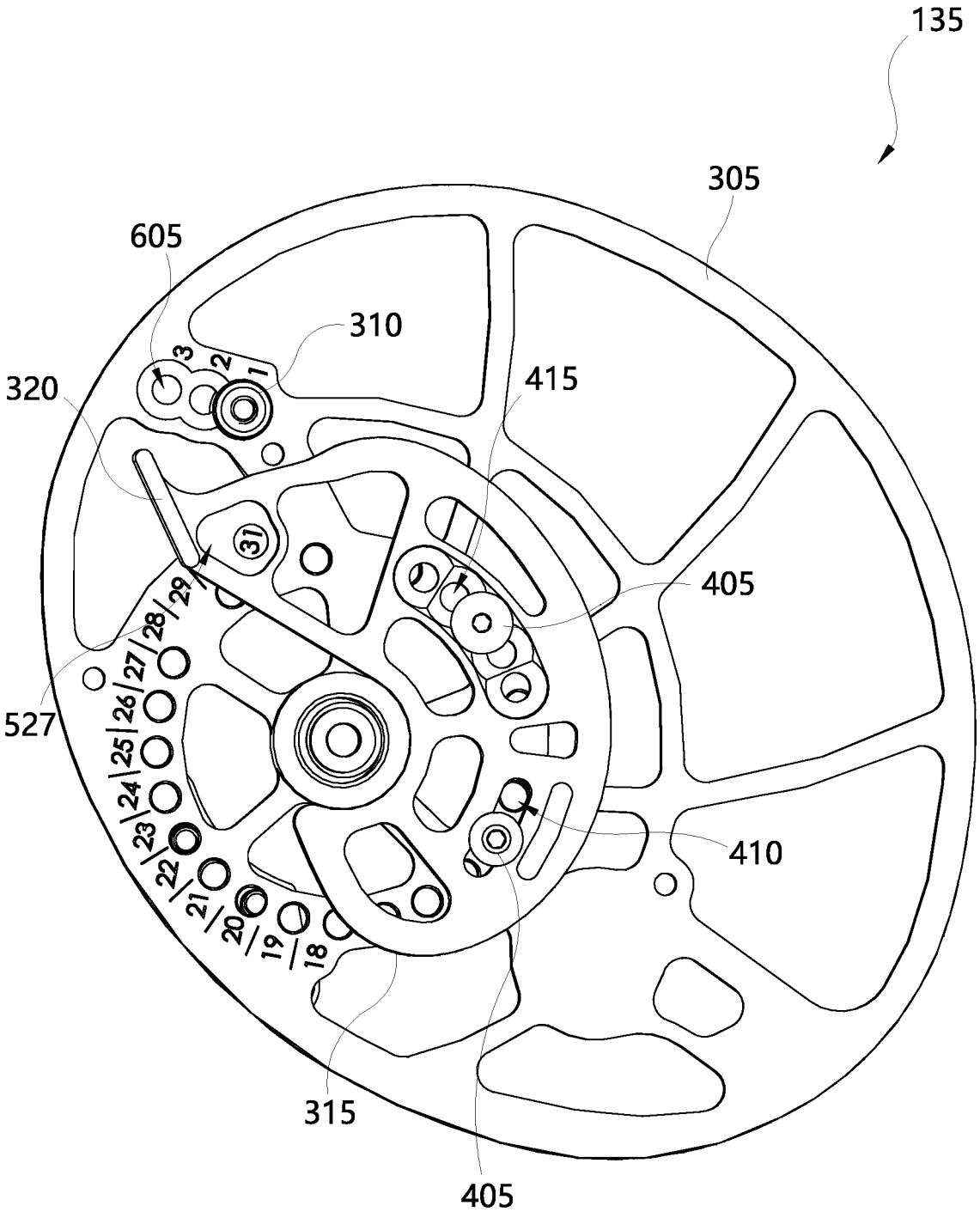
FIG. 7 is side view of a first side of the slave/driven cam of FIG. 3.
Figure 8:
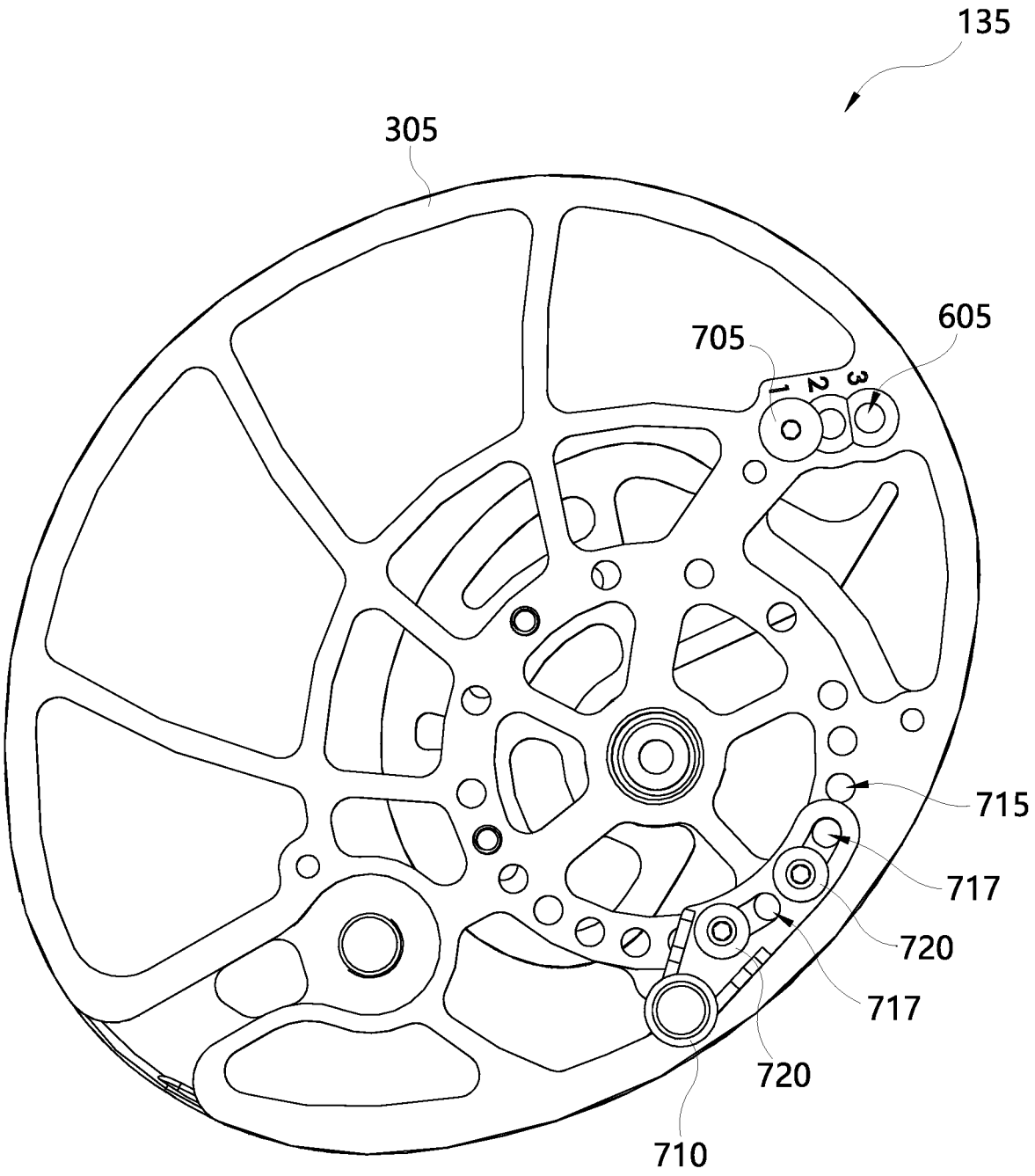
FIG. 8 is a side view of a second side of the slave/driven cam of FIG. 3.
Figure 9:
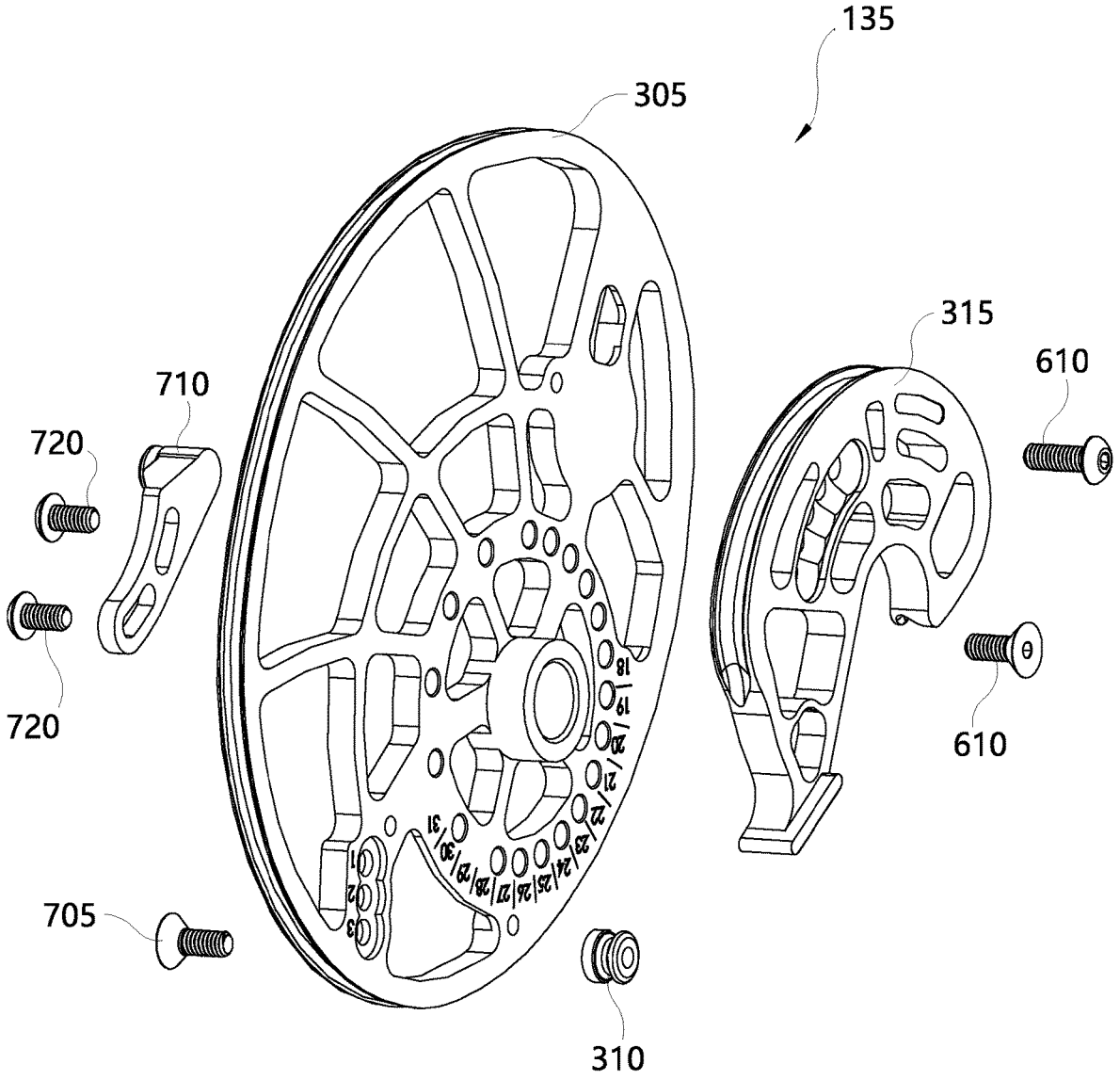
FIG. 9 is an exploded view of the slave/driven cam of FIG. 3.

Shown in FIGS. 7, 8, and 9 are multiple views of the upper cam 135. The upper cam 135 includes the adjustment module 315. The adjustment module 315 is configured to rotate about an axis formed by the upper axle 140 to select a desired draw length value. However, the upper cam 135 does not include a control module, thus the adjustment module 315 is not rotationally constrained unlike the adjustment module 215. For example, the fasteners 405 may be removed and the adjustment module 315 rotated until the window 527 displays the desired draw length value. The fasteners 405 may be inserted into the slot 410 and the holes 415 and tightened to secure the adjustment module 315 at the selected draw length.

The adjustable control cable post 310 is mounted to the upper cam 135 via a fastener 705. The fastener 705 extends through a post adjustment aperture 605 based on the desired draw length range of the archery bow 100. Typically, the post adjustment aperture 605 selected for the adjustable control cable post 310 is the same as the draw range aperture 505 selected for the control module 220. Thus, a first post adjustment aperture 605 corresponds to a draw length range from 26.5-31 inches, a second post adjustment aperture 605 corresponds to a draw length range from 22-26 inches, and a third post adjustment aperture 605 corresponds to a draw length range from 18-21.5 inches.

As can be seen in FIG. 8, the upper cam 135 may optionally include a limb stop 710. The limb stop 710 may be used in addition to and/or in place of the cable stop 320. The limb stop 710 is mounted to the upper cam 135 via one or more fasteners 720 threadedly connected to one or more adjustment holes 715. The limb stop 710 further includes one or more slots 717 configured to enable an archer to fine tune the position of the limb stop 710. As should be appreciated, the position of the limb stop 710 may correspond with the draw length selected for the adjustment module 215 and/or the control module 220.

Figure 10:
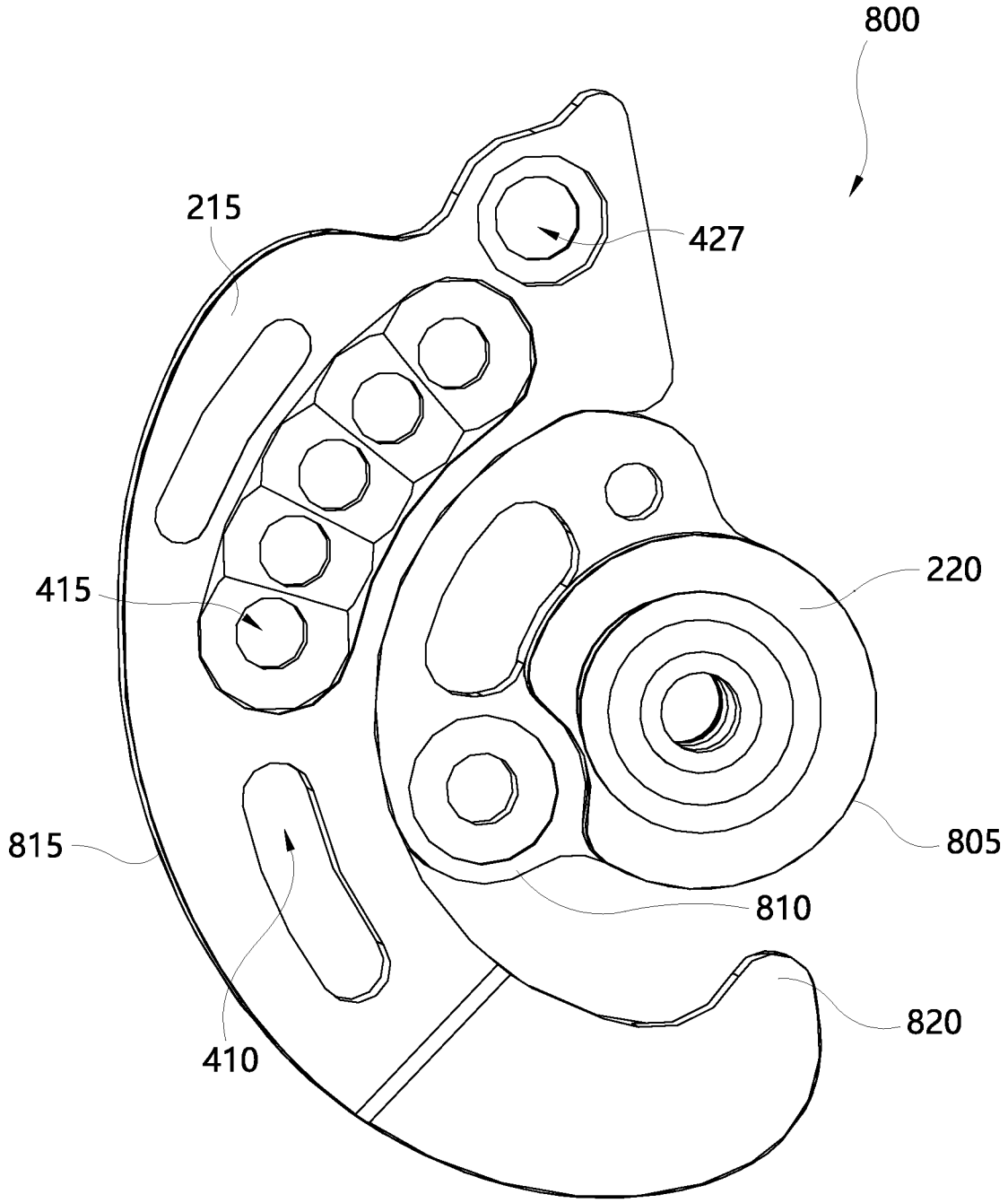
FIG. 10 is a side view of a draw length adjustment system of the cam system.

Turning to FIG. 10, an example of a draw length adjustment system 800 is shown. The the control module 220 includes a body 805 and a lug 810 and adjustment module 215 includes a shank 815 and a hook 820. The hook 820 and lug 810 are configured to lock together and/or abut when the adjustment module 215 reaches the limit of its rotation range. This prevents any further change in draw length of the archery bow 100 without a corresponding adjustment in the control module 220. Thus, an archer is prevented from accidentally improperly adjusting the draw length and/or improperly adjusting the control module 220 and/or adjustment module 215.

Figure 11:
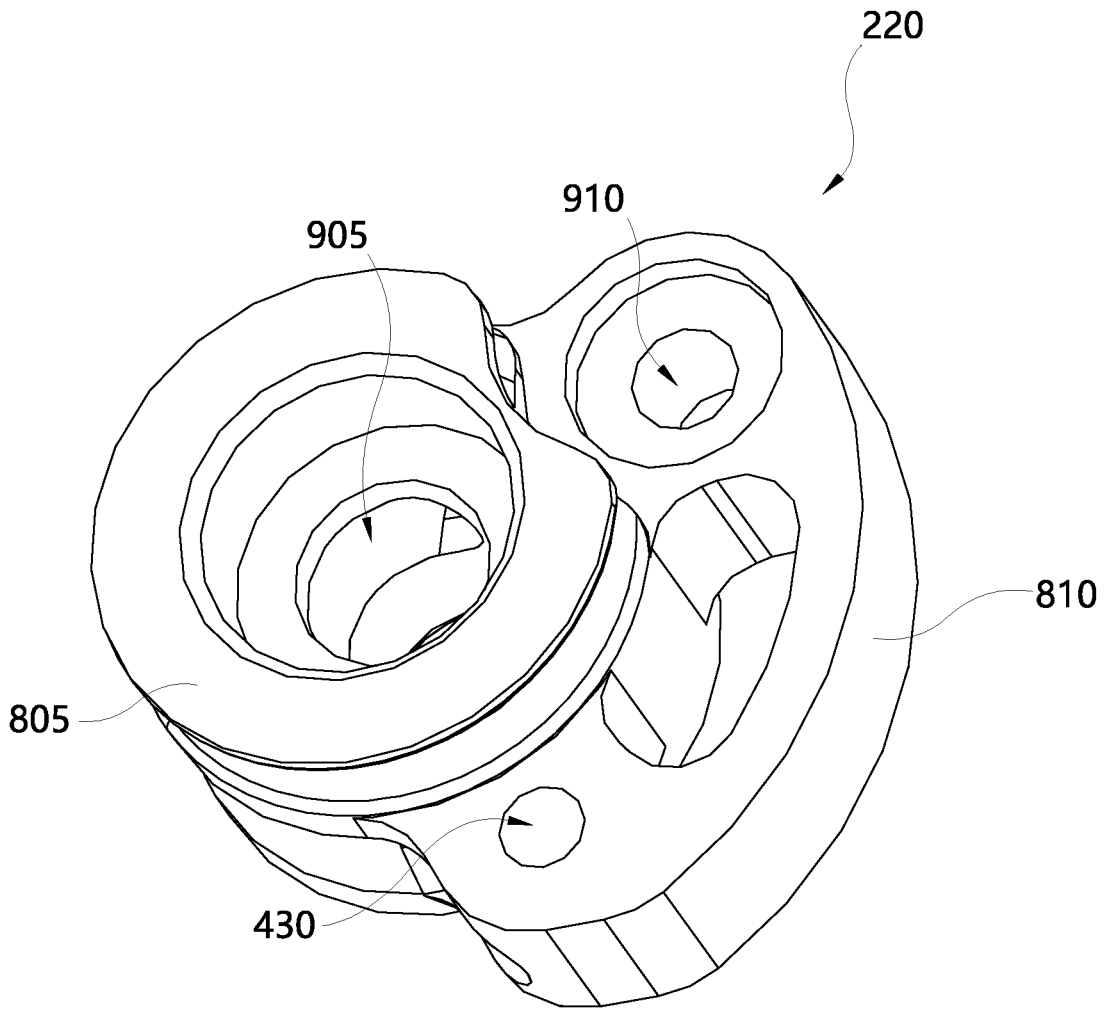
FIG. 11 is a perspective view of a control module of the draw length adjustment system of FIG. 10.

As illustrated in FIG. 11, the control module 220 includes an axle receptacle 905 and a post aperture 910. The axle receptacle 905 is configured to receive the lower axle 130 such that the control module 220 rotates around an axis formed by the 130. The post aperture 910 is configured to receive and secure the control cable post 225 via the fastener 430.

While the disclosure has been illustrated and described in detail in the drawings and foregoing description, the same is to be considered as illustrative and not restrictive in character, it being understood that only the preferred embodiment has been shown and described and that all changes and modifications that come within the spirit of the disclosure are desired to be protected.

What is claimed is:

1. A cam system for an archery bow, comprising:

a master cam configured to be mounted to an archery bow at a first axle;

a control module mounted to the master cam in a mounting position selected from a plurality of mounting positions wherein each mounting position determines a corresponding draw length range;

a draw length adjustment module mounted to the master cam and engaged with the control module, wherein the draw length adjustment module is mounted in a draw length position selected from a series of draw length positions within the draw length range determined by mounting position of the control module, wherein the draw length adjustment module position defines the draw length of the archery bow; and wherein the control module and the draw length adjustment module are rotatable about an axis formed by the first axle.

2. The cam system of claim 1, wherein the control module is rotatable between three distinct mounting positions corresponding to three distinct draw length ranges.

3. The cam system of claim 2, wherein the draw length adjustment module is rotatably engaged with the control module.

4. The cam system of claim 3, wherein the draw length adjustment module is rotatable between at least three distinct draw length positions within the draw length range determined by the mounting position of the control module.

5. The cam system of claim 3, wherein the draw length adjustment module includes a shank extending into a hook, wherein the hook limits the range in which the draw length adjustment module can rotate relative to the control module.

6. The cam system of claim 5, wherein the control module includes a body with a protruding lug configured to interact with the hook to form an adjustment stop.

7. The cam system of claim 1, comprising:

a driven cam configured to be mounted to the archery bow opposite the master cam; and a control cable post mounted to the driven cam in a position selected from a plurality of post positions wherein each post position corresponds to a control module position.

8. The cam system of claim 1, wherein the draw length adjustment module includes a peripheral track configured to take up a portion of a buss cable when the bow is drawn.

9. The cam system of claim 1, wherein the control module includes a peripheral track configured to receive or pay out a control cable when a bowstring is drawn or released.

10. The cam system of claim 1, wherein the draw length adjustment module defines a window enabling an archer to view a draw length indicator inscribed on the master cam to indicate the draw length of the archery bow defined by the position of the draw length adjustment module.

11. A cam system for an archery bow, comprising:

a master cam mounted to an archery bow at a first axle;

a control module mounted to the master cam in a position selected from a plurality of mounting positions;

a draw length adjustment module mounted to the master cam and rotationally engaged with the control module, wherein a rotational range of the draw length adjustment module is defined and limited by the control module position, and wherein the position of the draw length adjustment module defines the draw length of the archery bow; and wherein the control module and the draw length adjustment module are rotatable about an axis formed by the first axle.

12. The cam system of claim 11, comprising:

a driven cam mounted to the archery bow opposite the master cam; and a control cable post mounted to the driven cam in a position selected from a plurality of post locations wherein each post location corresponds to a control module position.

13. The cam system of claim 11, wherein the control module is rotatable between the plurality of mounting positions, wherein each mounting position defines a distinct draw length range.

14. The cam system of claim 11, wherein the draw length adjustment module includes a shank extending into a hook, wherein the hook limits the range in which the draw length adjustment module can rotate relative to the control module.

15. The cam system of claim 11, wherein the draw length adjustment module defines a window enabling an archer to view a draw length indicator inscribed on the master cam to indicate the draw length of the archery bow defined by the position of the draw length adjustment module.

* * * * *